United States Patent [19]

Malcolm et al.

[11] 4,001,736

[45] Jan. 4, 1977

[54] DIRECT CONTACT ROTARY ATTENUATOR

[76] Inventors: Bruce G. Malcolm, 4438 N. Kenmore Road, Indianapolis, Ind. 46226; William P. Dawson, 9201 Central Ave., Indianapolis, Ind. 46240

[22] Filed: Dec. 30, 1975

[21] Appl. No.: 645,360

[52] U.S. Cl. ..... 333/81 A; 338/216

[51] Int. Cl.² ..... H01P 1/22

[58] Field of Search ..... 333/81 R, 81 A; 334/50; 323/80; 338/76

[56] References Cited

UNITED STATES PATENTS

| | | | |
|---|---|---|---|
| 3,070,763 | 12/1962 | Reslock | 333/81 R |
| 3,260,971 | 7/1966 | Bacher et al. | 333/81 A |
| 3,622,919 | 11/1971 | Wilhoit | 333/81 R X |

*Primary Examiner*—Paul L. Gensler

[57] ABSTRACT

A rotary step attenuator having a housing and a rotor rotatably mounted in the housing. An array of attenuator elements is mounted on the rotor, appearing in an end view as chords of a circle whose center is at the axis of rotation of the rotor. Each attenuator element has a first surface bearing an electrically conductive pad facing the axis of rotation of the rotor, and additionally there is a blade contact member having a first surface facing away from the axis of rotation mounted in a fixed position relative to the housing and operable to touch a selected one of the conductive pads as the rotor is rotated within the housing. There are no spring biased signal contacts other than the blade contact member itself for effecting electrical coupling between the attenuator elements and the electrical connections to the rotary step attenuator.

14 Claims, 7 Drawing Figures

DIRECT CONTACT ROTARY ATTENUATOR

BACKGROUND OF THE INVENTION

1. Field of the Invention

This invention is in the field of attenuators.

2. Description of the Prior Art

Typical prior art rotary step attenuators utilize various spring-loaded contacts and combinations of contacts in order to provide electrical coupling between the cables leading to the attenuators and the attenuator pads mounted therein on a rotor. Such attenuators include, for example, those shown in U.S. Pat. No. 3,299,373 to Conney, No. 3,219,953 to Schwartz, No. 3,550,046 to Bacher, and No. 3,622,919 to Wilhoit. These spring biased contact assemblies are expensive to produce and are subject to mechanical failures in the assembly. A rotary step attenuator having a more direct contact method, though without providing contact to the attenuator elements themselves, is shown in U.S. Pat. No. 3,805,209 to Keranen. A direct contact attenuator, described as being for use from DC to above 8 GHz, lacking discrete attenuator elements but utilizing direct contact onto a resistive pad, is shown in U.S. Pat. No. 3,786,374 to Bergfried.

SUMMARY OF THE INVENTION

One embodiment of the present invention is a rotary attenuator comprising a housing, a rotor rotatably mounted in the housing and having an axis of rotation, a plurality of attenuator elements mounted on the rotor, each said element having a first surface bearing an electrically conductive pad generally facing the axis of rotation, a contact member having a first surface generally facing away from the axis of rotation which touches a selected one of said pads, the contact member being positioned to touch other of said pads as the rotor is rotated relative to the housing and connector means for coupling the contact member to external electronic circuitry and for mounting the contact member relative to the housing.

It is an object of the present invention to provide a rotary attenuator having a contact member making direct contact with a portion of each of the attenuator elements.

It is a further object of the present invention to provide such a rotary attenuator in which the attenuator elements have a face bearing an electrically conductive pad facing generally inwardly toward the axis of rotation on a rotatable rotor with a contact member operable to contact each pad successively as the rotor is rotated.

Further objects and advantages of the present invention shall be apparent from the following detailed description and accompanying figures.

DESCRIPTION OF THE PREFERRED EMBODIMENT

Figure 1:
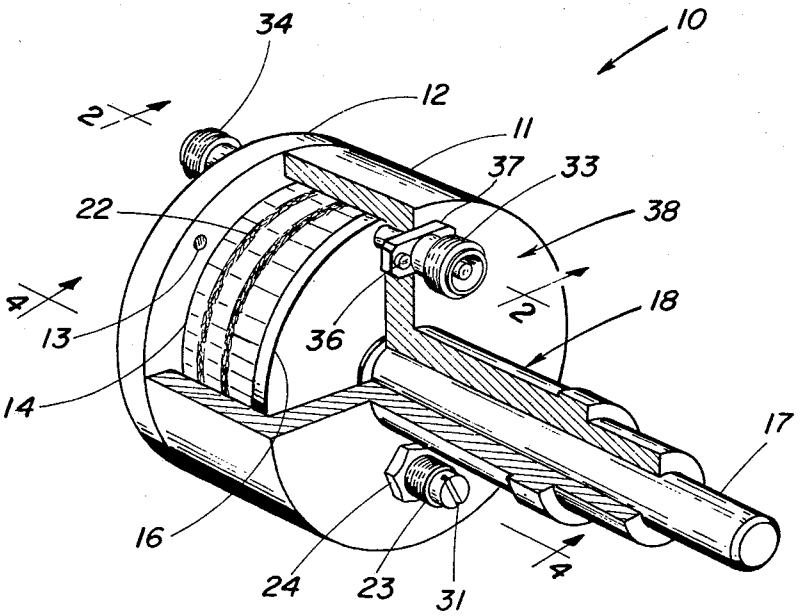
FIG. 1 is a perspective view of a rotary step attenuator according to the present invention with a portion removed.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring in particular to FIG. 1, there is shown a rotary step attenuator 10 embodying the present invention. Attenuator 10 includes an electrically conductive enclosure 11 and an electrically conductive backplate 12 which is rigidly attached to enclosure 11 by screws inserted through openings such as 13 in backplate 12 and threadedly received in enclosure 11. A rotor 14 and a pressure plate 16 are mounted within the enclosure 11. The rotor and pressure plate are also electrically conductive. Rotor 14 carries the actual attenuator elements, as shall be described more particularly hereinafter, and is rotatably mounted within the enclosure on shaft 17.

Figure 4:
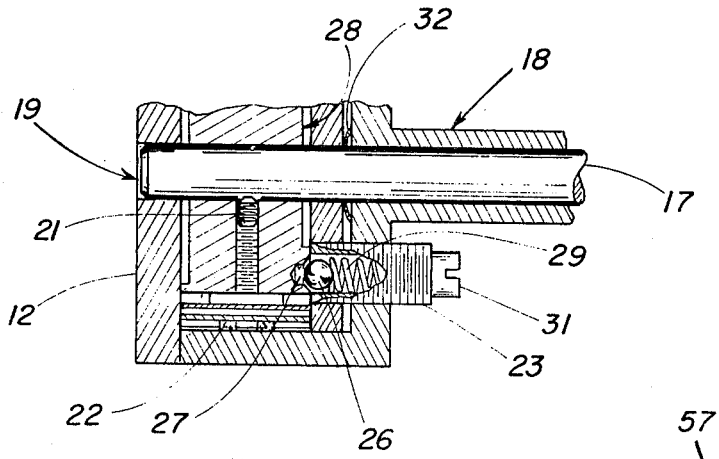
FIG. 4 is a partial sectional view taken on the line 4—4 of FIG. 1 in the direction of the arrows.

Referring now to FIG. 4 as well as FIG. 1, shaft 17 is mounted in elongated portion 18 of the enclosure 11 and an opening 19 in backplate 12. A headless screw 21 is inserted through a transverse bore in rotor 14 and threadedly received in an opening in the side of shaft 17, thereby rigidly attaching the rotor to the shaft. Wire braid such as 22 which alternatively may be a spring finger material, is received in each of two circumferential slots in rotor 14 providing grounding of the rotor body to the inside of enclosure 11 as the rotor is rotated within the enclosure.

A detent mechanism 23 is fixedly mounted to enclosure 11 by nut 24. Ball 26 of detent mechanism 23 is received in one hole of a plurality of holes in face 28 of rotor 14 such as hole 27. A hole such as 27 is associated with each attenuator element mounted in the rotor, as shall be discussed more particularly hereinafter, providing a series of detent positions as the rotor 14 is rotated by turning shaft 17. Detent ball 26 is urged into holes 27 by spring 29 whose tension is adjustable by rotating adjustment member 31, as is well known.

A spring washer 32 is received around shaft 17 between pressure plate 16 and enclosure 11, urging the pressure plate against rotor 14 and consequently also urging rotor 14 against backplate 12. The body of detent mechanism 23 is received in an appropriately-sized aperture through pressure plate 16, the pressure plate being permitted only axial movement in opposition to spring washer 32.

Figure 2:
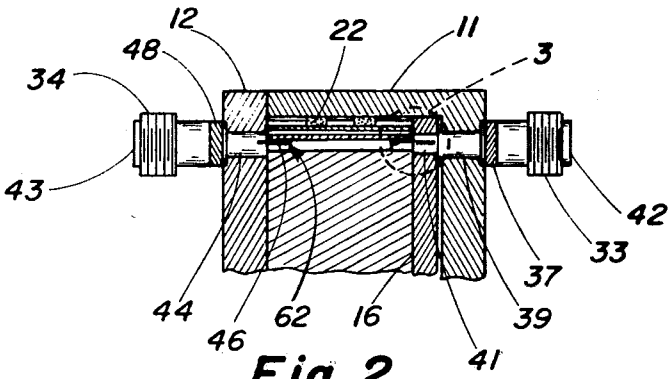
FIG. 2 is a partial sectional view taken along the line 2—2 of FIG. 1 in the direction of the arrows.
Figure 7:
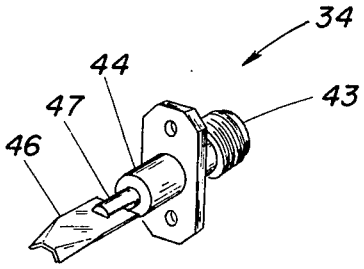
FIG. 7 is an enlarged perspective view of the connector contact member of the embodiment of FIG. 1.

Referring now to FIG. 2 in coordination with FIG. 1, input and output SMA connectors 33 and 34, respectively, are shown. These connectors have the standard terminations for coupling to coaxial cables external to enclosure 11 and backplate 12. Connectors 33 and 34 are similarly mounted to the enclosure 11 and backplate 12, respectively. For example, a collar 37 on connector 33 is mounted to enclosure 11 by two screws such as 36, which extend through collar 37 and are threadedly received in holes in the front surface 38 of enclosure 11. Rear connector 34 includes an outer shielding conductor 43 which is electrically coupled to collar 48 and therefore backplate 12. A cylindrical insulating member 44 surrounds a center conductor 47 (FIG. 7) and extends through a hole in backplate 12. Center conductor 47 receives and rigidly holds a blade contact 46 which contacts a portion of an attenuator element as rotor 14 is rotated, as shall be described more particularly hereinafter. Blade contact 46 is preferably heat-treated Paliney 7 of the J. M. Ney Co., Bloomfield, Conn. or other appropriate contact alloy. The primary requisites for the blade being resilience and electrical conductivity.

Figure 3:
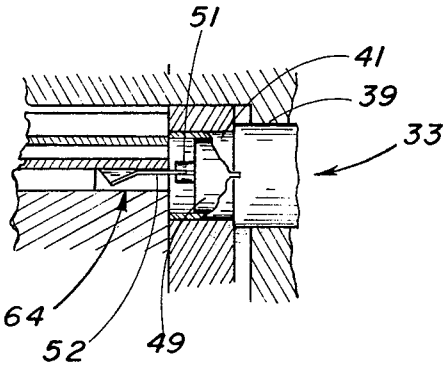
FIG. 3 is an enlarged view of a portion of FIG. 2.

The outer conductor 42 of connector 33 is similarly grounded through flange 37 to enclosure 11. Referring also to FIG. 3, connector 33 has an insulating member 49 surrounding center conductor 51, which is slotted and retains contact blade 52, of the same material as blade 46, for contacting an end of the attenuator elements mounted in rotor 14. A contact shield of electrically conductive material is provided over insulator 49 and includes a larger-diameter portion 39 received within the hole through enclosure 11 for connector 33 and also a smaller-diameter portion 41 received within a hole through pressure plate 16. Portion 41 is slotted and sized slightly larger than the hole through pressure plate 16 so that when it is inserted through the hole in the pressure plate, a good spring contact is made between portion 41 and the side wall of the opening through the pressure plate. The contact shield thereby provides good electrical grounding contact from pressure plate 16 to the enclosure 11 at all times and despite any axial movement of the pressure plate.

Figure 6:
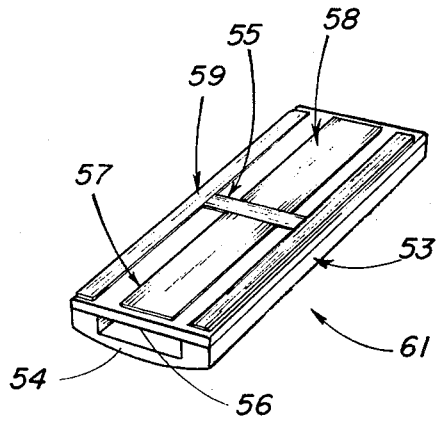
FIG. 6 is a perspective view of an attenuator element assembly, positioned in the rotor.
Figure 5:
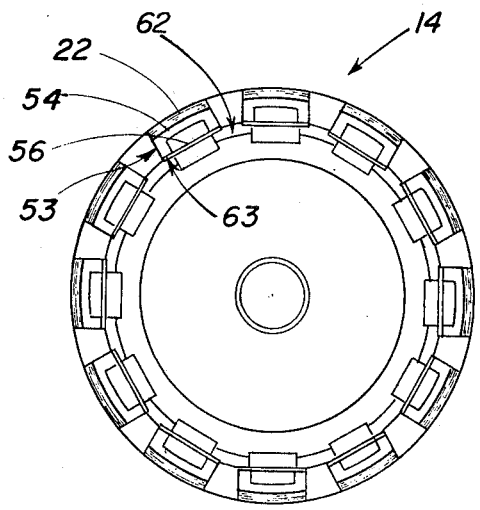
FIG. 5 is an end view of the rotor of the embodiment of FIG. 1.

Referring now to FIG. 5 and 6, rotor 14 and an attenuator assembly 61 typical of those mounted in the rotor are shown. Attenuator assembly 61 includes a film attenuator element 56 and a ground plane plate 54, which are fixedly mounted within an appropriately sized opening in rotor 14, the side of film attenuator element 56 having ground pads such as 59 bearing against shoulders such as 63 of the rotor 14 along the grounding pads. The edges 53 of the ground plane plate 54 are soldered in place in the rotor 14. An annular recess 62 (FIG. 2 and 5) receives blade 46 coupled from the center conductor of connector 34. The blade 46 remains in a fixed position relative to the housing and, as rotor 14 is rotated by turning shaft 17, a selected attenuator element is positioned such that blade 46 is in electrical contact with an end of the conductive pad 58. The conductive, or contact, pads (such as 57 and 58) are preferably of a gold over chromium material, and the contact pads are electrically connected to deposited attenuator region 55, which may alternatively be any other attenuator pad such as a discrete resistor network.

Similarly, the opposite face of rotor 14 from that viewed in FIG. 5 contains a similar annular recess 64 (FIG. 2 and 3) which receives blade 52 coupled from the center conductor of front connector 33. In similar fashion to that described above for blade contact 46, blade contact 52 is couplable to a selected contact pad such as 57 (FIG. 6), providing electrical contact thereto. The exact configuration of attenuator element 56 is not critical to the invention, and various more complex (or simply) conductive attenuator elements may be constructed to be mounted in rotor 14. It is generally preferable, however, to maintain the portion such as 57 or 58 to be contacted by a blade contact member generally central of the end portion of pad 56 as is the case of the element shown in FIG. 6. For typical high frequency applications, it is necessary to maintain a, for example, 50 or 75 ohm characteristic impedance for contact pads 57 and 58, matching the center conductor characteristic impedance of the cables attached to connectors 33 and 34.

As can be seen from FIG. 5, each attenuator element forms a small chord around the perimeter of a circle. Therefore the closest portion of each contact pad to the axis of rotation is at the center of the pad as viewed from the end as it is in FIG. 5. Therefore the blade contacts are positioned to provide a sufficient spring force for contact against pads 57 or 58 while, when the rotor is moving, due to the larger radius there is little or no contact between the blade and the outside of the annular slot such as 62 in which it rides.

Three considerations in the construction of the present embodiment provide RF leakage sealing. A floating seal contact plate, pressure plate 16, is maintained against one face of rotor 14 by spring washer 32, and consequently there is a similar continuous contact between the rear face of the rotor and backplate 12. Thus, even though rotor 14 is rotated for selection of the desired attenuator element, a more or less continuous ground plane is maintained on each face of the rotor. Circumferential grounding for the rotating rotor is further provided by the wire braid or spring finger stock in the circumferential slots on the outer edge of rotor 14. RF leakage between adjacent attenuator elements is prevented by the use of a sufficiently small annular groove on each face of the rotor, such as groove 62 of FIG. 5, that the groove acts as a cut-off wave guide at all frequencies of interest. In one embodiment, with each groove being about 0.088 inches in width, the groove will pass only very high frequencies on the order of 50 Ghz. or higher.

The spring contact of the contact shield, as best shown in FIG. 3, prevents leakage from the SMA connector through the pressure plate to the housing 11. The contact shield establishes a good fixed ground from the pressure plate 16 to the housing even though the pressure plate is free-floating axially to same extent, primarily positioned by spring washer 32 as to motion along the axis of rotation of the rotor.

While there have been described above the principles of this invention in connection with specific apparatus, it is to be clearly understood that this description is made only by way of example and not as a limitation in the scope of the invention.

What is claimed is:

1. A rotary attenuator comprising:

a housing;

a rotor rotatably mounted in the housing and having an axis of rotation;

a plurality of attenuator elements mounted on the rotor, each said element having an attenuator pad and a first surface bearing a contact pad, electrically coupled to the attenuator pad, generally facing the axis of rotation;

a first contact member having a first surface generally facing away from the axis of rotation which touches a selected one of said contact pads, the contact member being positioned to touch other of said contact pads as the rotor is rotated relative to the housing; and first connector means for coupling the contact member to external electronic circuitry and for mounting the contact member relative to the housing.

2. The rotary attenuator of claim 1 in which the first surfaces of the attenuator elements are generally flat surfaces and are arrayed, in an end view, as chords of a circle about the axis of rotation of the rotor, the contact pad of each said first surface being generally centrally located along the chord.

3. The attenuator of claim 2 in which the first surface of each attenuator element includes the attenuator pad, is generally rectangular and generally parallel to the axis of rotation of the rotor, the first surfaces of the attenuator elements being arranged in a generally cylindrical array such that in cross-sections transverse to the axis of rotation of the rotor the first surfaces appear as chords of a circle whose center is on the axis of rotation and the coupling between the contact pad and the attenuator pad being of a constant characteristic impedance.

4. The rotary attenuator of claim 3 in which the first surface of each attenuator element bears a first contact pad at an end of the first surface and a second contact pad at the opposite end of the first surface and further comprising a second contact member having a first surface generally facing away from the axis of rotation which touches a selected one of said second contact pads, the second contact member being positioned to touch other of said second contact pads as the rotor is rotated relative to the housing, and second connector means for coupling second contact member to external electronic circuitry and for mounting the second contact member relative to the housing.

5. The rotary attenuator of claim 4 in which the housing and rotor are generally cylindrical, the outside diameter of the rotor being slightly less than the inside diameter of the housing, the rotor and the housing each being electrically conductive and the circumferential surface of the rotor including a slot receiving an electrically conductive braid maintaining electrical connection between the housing and the rotor.

6. The rotary attenuator of claim 1 in which the rotor has a first and a second generally flat surface on opposite ends transverse to the axis of rotation, and further comprising:

a pressure plate mounted in the housing and having a first surface bearing against the first surface of the rotor;

and spring bias means for maintaining the contact between the pressure plate and the rotor and for maintaining the second surface of the rotor against an interior surface of the housing, the rotor, the housing and the pressure plate being electrically conductive.

7. The rotary attenuator of claim 6 in which the first connector means includes a center conductor member extending through the housing and into an aperture in the pressure plate, the contact member being received on the center conductor member and further comprising:

a contact shield of electrically conductive material having a first portion received within an opening in the housing for the connector means and having a second portion surrounding and spaced apart from the center conductor received within the aperture in the pressure plate for the center conductor.

8. The rotary attenuator of claim 7 in which the first surface of the rotor includes a first annular groove, one wall of which is defined by the inwardly facing surfaces of the plurality of attenuator elements, the first contact member being received in the groove spaced-apart from the continuous portions of the rotor.

9. The rotary attenuator of claim 8 which further comprises:

a shaft extending through the housing and rigidly attached to the rotor along its axis of rotation; and detent means for providing a plurality of detented positions for the rotor as the rotor and shaft are rotated relative to the housing.

10. The rotary attenuator of claim 4 in which the rotor has a first and a second generally flat surface on opposite ends transverse to the axis of rotation, and further comprising:

a pressure plate mounted in the housing and having a first surface bearing against the first surface of the rotor;

and spring bias means for maintaining the contact between the pressure plate and the rotor and for maintaining the second surface of the rotor against an interior surface of the housing, the rotor, the housing and the pressure plate being electrically conductive.

11. The rotary attenuator of claim 10 in which the first connector means includes a center conductor member extending through the housing and into an aperture in the pressure plate, the contact member being received on the center conductor member and further comprising:

a contact shield of electrically conductive material having a first portion received within an opening in the housing for the connector means and having a second portion surrounding and spaced apart from the center conductor received within the aperture in the pressure plate for the center conductor.

12. The rotary attenuator of claim 11 in which the first surface of the rotor includes a first annular groove, one wall of which is defined by the inwardly facing surfaces of the plurality of attenuator elements, the first contact member being received in the groove spaced-apart from the continuous portions of the rotor.

13. The rotary attenuator of claim 12 which further comprises:

a shaft extending through the housing and rigidly attached to the rotor along its axis of rotation; and detent means for providing a plurality of detented positions for the rotor as the rotor and shaft are rotated relative to the housing.

14. The rotary attenuator of claim 13 in which the second surface of the rotor includes a second annular groove, one wall of which is defined by the inwardly facing surfaces of the plurality of attenuator elements, the second contact member being received in the groove spaced-apart from the continuous portions of the rotor.

* * * * *